United States Patent [19]

Fletcher et al.

[11] 3,996,464

[45] Dec. 7, 1976

[54] MASS SPECTROMETER WITH MAGNETIC POLE PIECES PROVIDING THE MAGNETIC FIELDS FOR BOTH THE MAGNETIC SECTOR AND AN ION-TYPE VACUUM PUMP

[76] Inventors: James C. Fletcher, Administrator of the National Aeronautics and Space Administration, with respect to an invention of; Leonard M. Sieradski, Altadena; Charles E. Giffin, Pasadena, both of Calif.; Alfred O. Nier, St. Paul, Minn.

[22] Filed: Nov. 21, 1975

[21] Appl. No.: 634,205

[52] U.S. Cl. ..... 250/289; 250/298

[51] Int. Cl.[2] ..... H01J 39/34

[58] Field of Search ..... 250/281, 282, 283, 284, 250/289, 298, 299, 300

[56] References Cited

UNITED STATES PATENTS 3,479,504 11/1969 Hull ..... 250/298

*Primary Examiner*—Craig E. Church

*Attorney, Agent, or Firm*—Monte F. Mott; Wilfred Grifka; John R. Manning

[57] ABSTRACT

A mass spectrometer (MS) with unique magnetic pole pieces which provide a homogenous magnetic field across the gap of the MS magnetic sector as well as the magnetic field across an ion-type vacuum pump is disclosed. The pole pieces form the top and bottom sides of a housing. The housing is positioned so that portions of the pole pieces form part of the magnetic sector with the space between them defining the gap region of the magnetic sector, through which an ion beam passes. The pole pieces extend beyond the magnetic sector with the space between them being large enough to accommodate the electrical parts of an ion-type vacuum pump. The pole pieces which provide the magnetic field for the pump, together with the housing form the vacuum pump enclosure or housing.

12 Claims, 4 Drawing Figures

MASS SPECTROMETER WITH MAGNETIC POLE PIECES PROVIDING THE MAGNETIC FIELDS FOR BOTH THE MAGNETIC SECTOR AND AN ION-TYPE VACUUM PUMP

ORGIN OF THE INVENTION

The invention described herein was made in the performance of work under a NASA contract and is subject to the provisions of Section 305 of the National Aeronautics and Space Act of 1958, Public Law 85–568 (72 Stat. 435; 42 USC 2457).

BACKGROUND OF THE INVENTION

1. Field of the Invention

The present invention generally relates to a magnetic sector mass spectrometer and, more particularly, to a mass spectrometer with a magnetic sector incorporating pole pieces which serve both the magnetic sector and provide the magnetic field of an ion-type vacuum pump.

2. Description of the Prior Art

In a mass spectrometer (MS) with a magnetic sector, whether the MS is of the single focusing or double focusing type, two magnetic fields are generally required. One magnetic field is required for the magnetic sector through which the ion beam passes in the gap between pole pieces of the magnetic sector. It is this magnetic field which causes the beam to turn, with the amount of turning depending upon the mass to charge ratio of the ions in the beam. The other magnetic field is required for the operation of the ion-type vacuum pump, which is generally used to evacuate the path in the MS through which the ion beam travels. The elements required to produce the two magnetic fields represent the major portion, in terms of weight and size, of the entire MS.

In a typical prior art small magnetic sector MS, the ion beam travels inside a non-magnetic stainless steel duct. The duct extends from the ion source, such as an ionization chamber, and in case of a double focusing type MS through an electric sector, and therefrom through the magnetic sector to the ion detector. It is this duct which the ion-type vacuum pump evacuates. Since the duct passes through the magnetic sector, the gap between the pole pieces fo the magnet, producing the magnetic field, has to be wide enough to accommodate the duct therein. The gap has to be wider than the ion beam height by at least twice the duct wall thickness, plus required assembly clearances.

It is well appreciated that the greater the gap between the pole pieces, the more magnetic material is needed for a desired flux density across the gap. More magnetic material represents increased weight and size of the magnetic sector. For a miniature portable MS the increased weight and size of the magnetic sector represent significant disadvantages. Therefore, for such a MS, the elimination of the duct is highly desirable, since without the duct, gap size can be greatly reduced thereby reducing the weight and size of the magnetic material required to produce the required flux density across the gap. Also, for a miniature portable MS, it is desirable to eliminate the need for separate magnetic material, in order to produce the magnetic field for the ion type vacuum pump, thereby further reducing the overall size and weight of the MS. Furhtermore, in such a portable MS, it is desirable to locate the pump as close as possible to the magnetic sector in order to eliminate the need to shield parts of the MS, which may be sensitive to a stray magnetic field, from the magnetic field of the pump, if the latter is located away from the magnetic sector.

SUMMARY OF THE INVENTION

In accordance with the invention, magnetic pole pieces with unique features are used to form the top and bottom side of an enclosed housing. The pole pieces are placed to form part of the magnetic sector, with a small gap between them through which the ion beam travels. The housing with the pole pieces extend beyond the magnetic sector, and form part of the ion-type vacuum pump enclosure. In the section of the housing extending beyond the magnetic sector, the space between the pole pieces is sufficiently large to accommodate therein the electrical parts of the vacuum pump, such as the cathodes and the anode. Thus, the pump is located at the magnetic sector and a direct path is provided between the gap of the magnetic sector and the pump which evacuates the gap. Two couplings are provided on the opposite sides of the housing. These are used to couple a first outer duct, through which the ion beam travels to the magnetic sector, and a second outer duct through which the dispersed ions travel from the magnetic sector to the ion detector. The vacuum pump in addition to evacuating the gap of the magnetic sector also evacuates the two outer ducts extending therefrom, and the remaining MS vacuum envelope, thereby evacuating the entire ion beam path in the MS.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
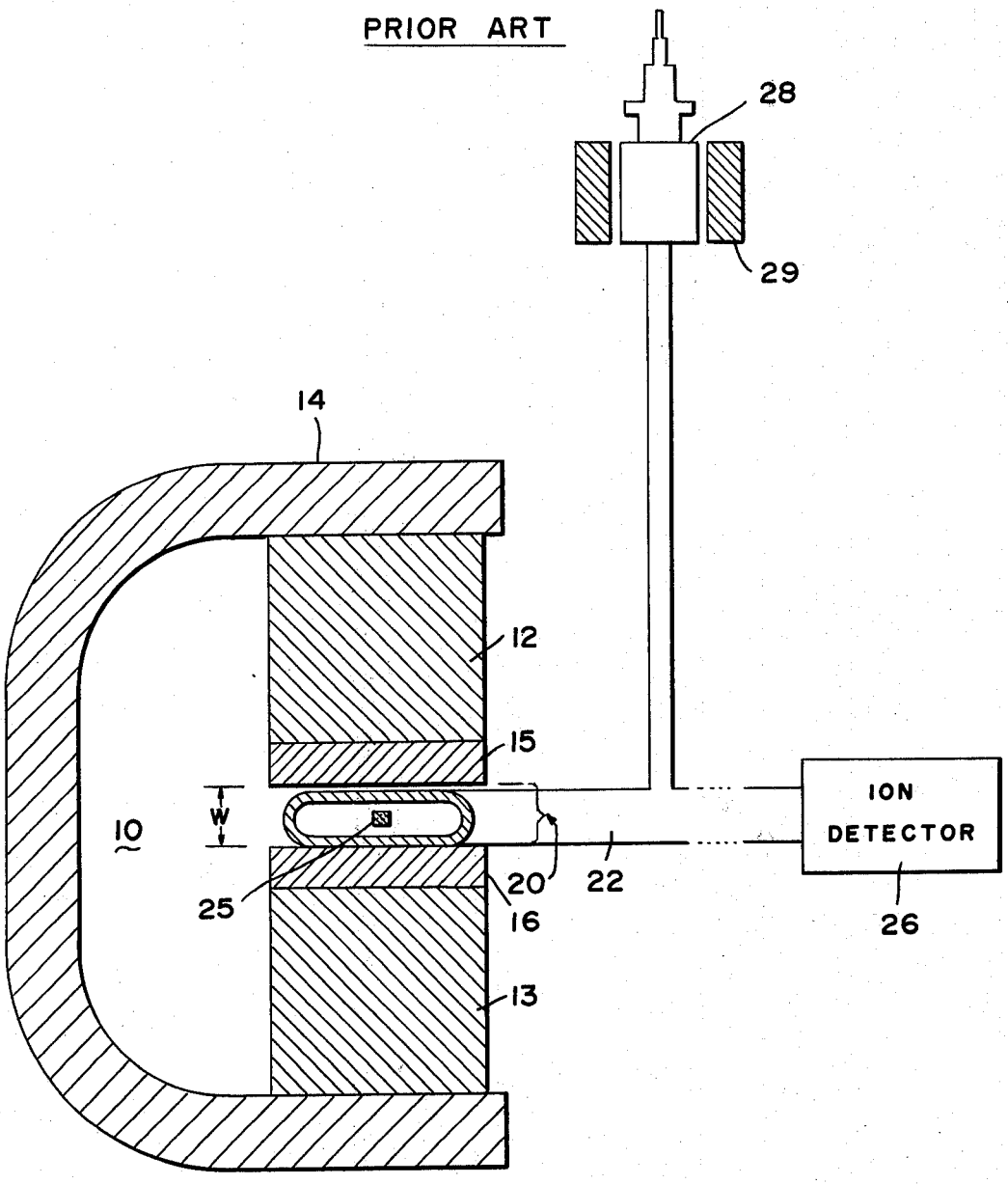
FIG. 1 PRIOR ART
FIG. 1 is a cross-sectional view of a prior art magnetic sector.

In order to highlight the advantages and the novel structure of the present invention, the disadvantages of the prior art will be discussed briefly and explained in connection with FIG. 1. Therein, the magnetic sector is shown in cross sectional view. The magnetic sector 10 typically includes a magnet, consisting of two spaced magnets 12 and 13 which are interconnected by a magnet yoke 14. Spaced apart magnetic pole pieces 15 and 16 are used to provide a homogenous magnetic field in the space or gap between the pole pieces, which represents the magnetic sector gap 20. The gap width is designated by W. A non-magnetic duct 22 is employed to provide a path for an ion beam 25 which travels from an ion source (not shown) through the magnetic sector gap 20 to an ion detector 26. The duct is evacuated by an ion-type vacuum pump 28, which requires a magnetic field, provided by a separate cylindrical magnet 29.

As is appreciated, since the duct 22 passes through the gap 20 the latter has to be wide enough to accommodate the duct therein. That is, W has to be large enough to accommodate the height of the ion beam and twice the duct wall thickness, plus required assembly clearances. The weight and size of the magnets 12 and 13 and yoke 14 are directly related to the gap width W for a desired flux density across the gap. If the need for the duct to pass through the gap can be eliminated, a smaller gap can be used and, therefore, the total weight and size of the magnetic sector can be greatly reduced. This is of particular importance when constructing a miniature portable MS. Also, to further reduce the MS size and weight, it is desirable to use the magnets 12 and 13 of the magnetic sector 10 to provide the magnetic field for the pump 28 and thereby eliminate the need for the separate magnet 29.

The present invention is directed to achieve these advantages. Briefly, in accordance with the present invention pole pieces with novel shapes are used to eliminate the need for the duct 22 to pass through gap 20, thereby enabling the use of a magnetic sector with a smaller gap. Also the pole pieces are shaped and extend from the magnetic sector to provide the required magnetic field for an internal vacuum pump, thereby eliminating the need for the separate magnet 29 and separate ion type vacuum pump 28.

Figure 2:
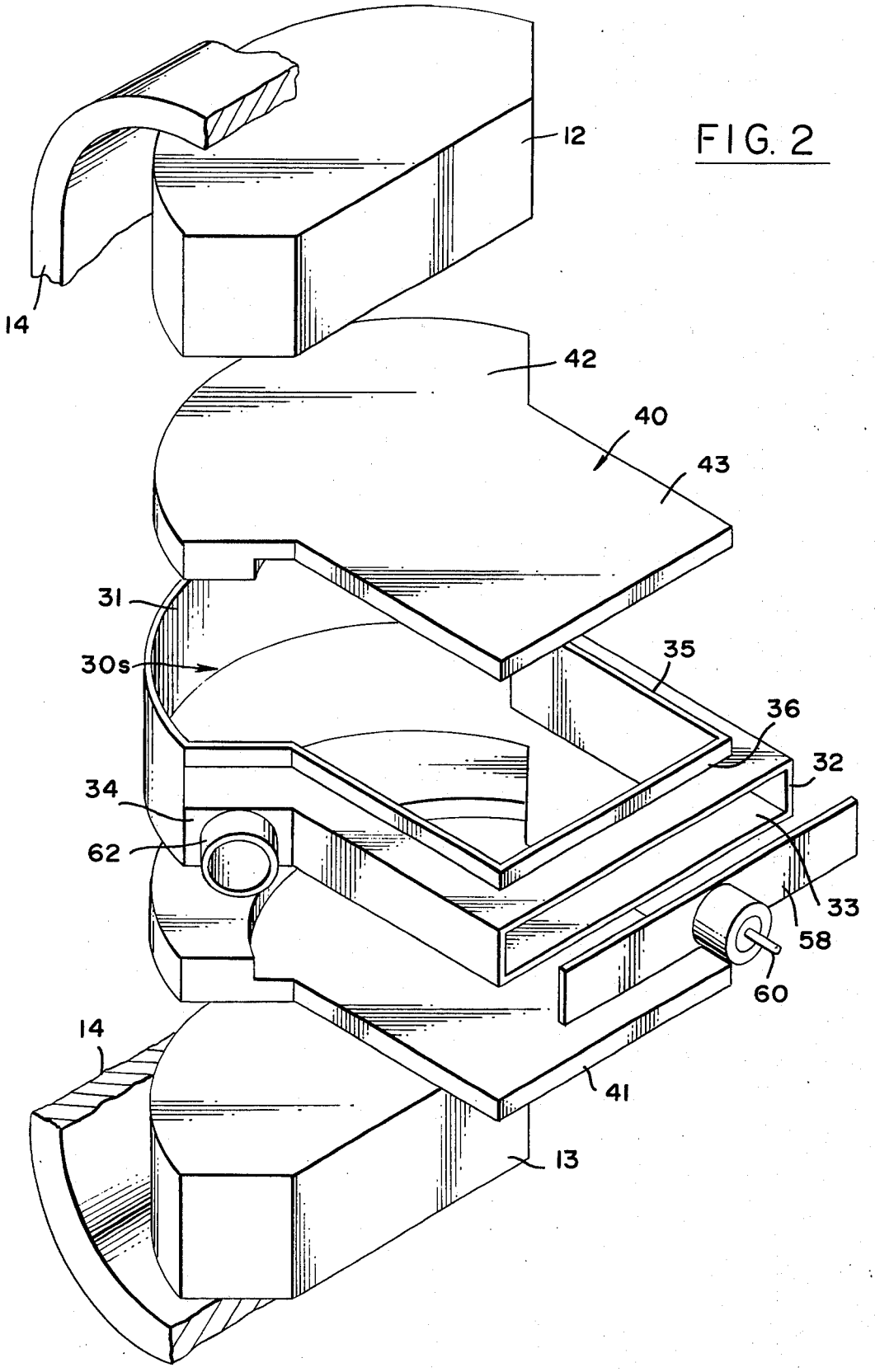
FIG. 2 is an expanded view of parts forming a magnetic sector and ion-type vacuum pump combination in accordance with the present invention.
Figure 3:
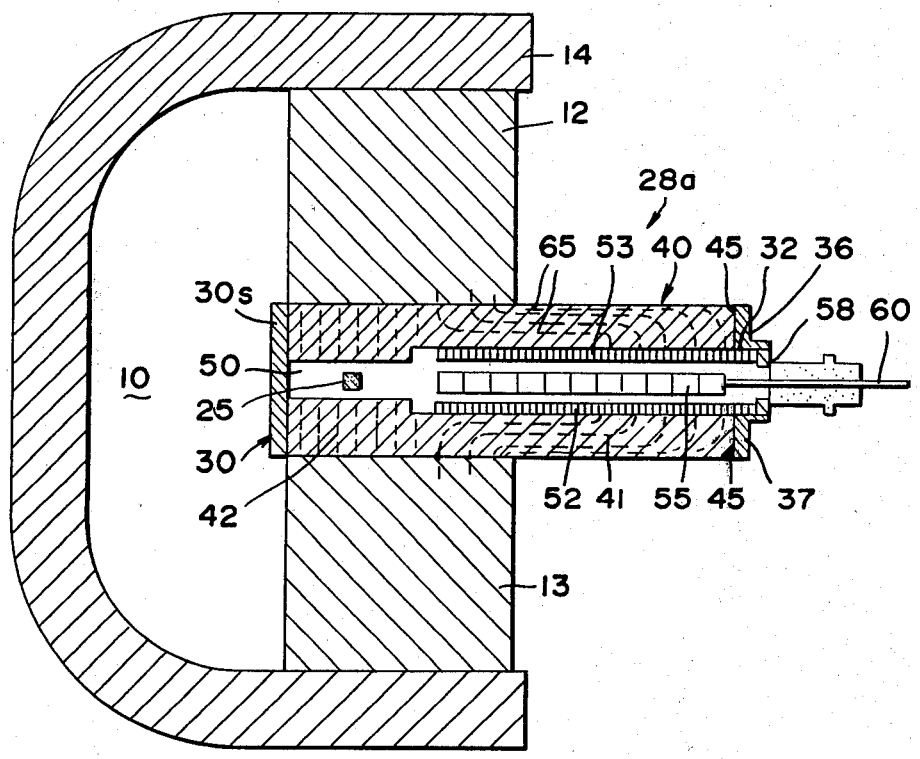
FIG. 3 is a cross-sectional view of a magnetic sector ion-type vacuum pump combination including the novel pole pieces of the present invention.

The invention will now be described in connection with FIGS. 2 and 3. FIG. 2 is an expanded view of various parts, forming a ductless magnetic sector and the enclosure of an ion-type vacuum pump, which is provided with a magnetic field by the magnets of the magnetic sector. FIG. 3 is a simplified cross sectional view of the ductless magnetic sector and the vacuum pump. In FIGS. 2 and 3 elements like those shown in FIG. 1 are designated by like numerals.

In accordance with the present invention a hollow structure 30s of the non-magnetic material, e.g., stainless steel, is provided. It, together with a pair of identical magnetic pole pieces 40 and 41 and non-magnetic end plate 58 which are welded to the structure 30s form a hollow housing 30, which defines the gap region of the magnetic sector and the vacuum pump enclosure. As seen from FIG. 2 the non-magnetic structure **30*s* has a circularly shaped back wall 31, an opposite front wall 32 which defines an opening 33 and two opposite side walls 34 and 35. These walls represent walls of housing 30. The top and bottom sides of structure 30*s* are open except for flanges 36 and 37** which extend therefrom.

The two pole pieces 40 and 41 form the top and bottom sides of housing 30. The top pole piece 40 is welded to the top flange 36 to form the top side of housing 30, while the pole piece 41 is welded to the bottom flange 37 to form the bottom side of housing 30. The welds are represented in FIG. 3 by 45. As shown in FIG. 2 each of the pole pieces has a sector shaped portion 42 from which a rectangularly shaped portion 43 extends. The thickness of each pole piece is not uniform. Most of the sector-shaped portion 42 is thicker than the rest of the pole piece. In one embodiment each pole piece was fabricated from magnetic 410 stainless steel.

As seen from FIG. 3 the pole pieces are welded, so that when the housing 30 is inserted into the magnetic sector, the sector shaped portions 42 of the pole pieces are aligned with the sector-shaped magnets 12 and 13, and the thicker sections of the pole pieces 40 and 41 are spaced apart. The distance between them defines the magnetic sector gap, represented by 50 and is formed with the required precision for optimum MS performance. The gap width is made sufficiently small to accommodate only the ion beam 25 passing therethrough. While the gap 50 is defined between the thicker portions of the pole pieces 40 and 41, the portion of the housing 30 between the thinner sections of the pole pieces is used to accommodate the electric parts of the ion-type vacuum pump.

The electric parts are assumed to include cathodes 52 and 53 and an anode 55. The cathodes and anode are assumed to be supported by the end plate 58 which is secured, such as by welding within opening 33 (see FIG. 2) of housing front wall 32. Thus, end plate 58 forms part of and seals the front wall of housing 30. Typically, the cathodes are grounded and the high voltage to the anode may be supplied from a terminal 60 which is electrically connected to the anode 55 through end plate 58. In one embodiment which was actually reduced to practice and as shown in FIG. 3 the cathodes 52 and 53 when inserted into the housing were tightly fit against the pole pieces which were at ground potential. The cathodes 52 and 53 wee machined with grooves at their contact with pole pieces 40 and 41 to eliminate a virtual leak.

From the foregoing it should thus be appreciated that when the pole pieces 40 and 41 and end plate 58 and external ducts 66 and 72 are welded to housing 30 the latter is vacuum tight. The pole pieces 40 and 41 act as the top and bottom sides of the enclosure of the vacuum pump, designated in FIG. 3 by **28*a*, while the space between the thicker sections of the pole pieces defined the gap of the magnetic sector. The path of the ion beam 25 through the magnetic sector is confined between the two pole pieces on the top and bottom, by the back wall 31 on one side (shown as the left side) and by the enclosed vacuum pump 28*a* on the other side. Thus, the need for a duct, such as duct 22, shown in FIG. 1, through the magnetic sector is eliminated. Consequently, the gap width can be made to be very small, since it needs to provide only clearance for the ion beam 25. In one embodiment the gap width was reduced to 0.100 inch as compared with a gap width of about 0.183 inch of a comparable prior art magnetic sector which requires a duct to pass through the gap. With the reduced gap width, smaller and lighter magnets 12 and 13 and yoke 14 may be used to provide the desired flux density across gap 50.**

Furthermore, it should be pointed out that since the vacuum pump is located contiguous with the magnets 12 and 13, the magnetic flux designated in FIG. 3 by lines 65, pass through the pole pieces which provide the uniform magnetic field for the vacuum pump **28*a***. Consequently, a separate cylindrical magnet for the pump is not required, thereby further reducing the total weight and size of the MS, which is particularly important for a miniature portable MS.

Another advantage is realizable by placing the vacuum pump contiguous with the magnetic sector. In the prior art the vacuum pump is generally located away from the magnetic sector. Therefore, magnetic shielding is often required to shield parts of the MS from the magnetic field provided for the pump by its separate magnet. However, in the present invention since the pump **28*a*** is located contiguous with the magnetic sector which provides the magnetic field therefor, separate magnetic shielding is not required. The elimination of such shielding further reduces the overall weight of the MS which is of particular importance for a portable miniature MS.

Figure 4:
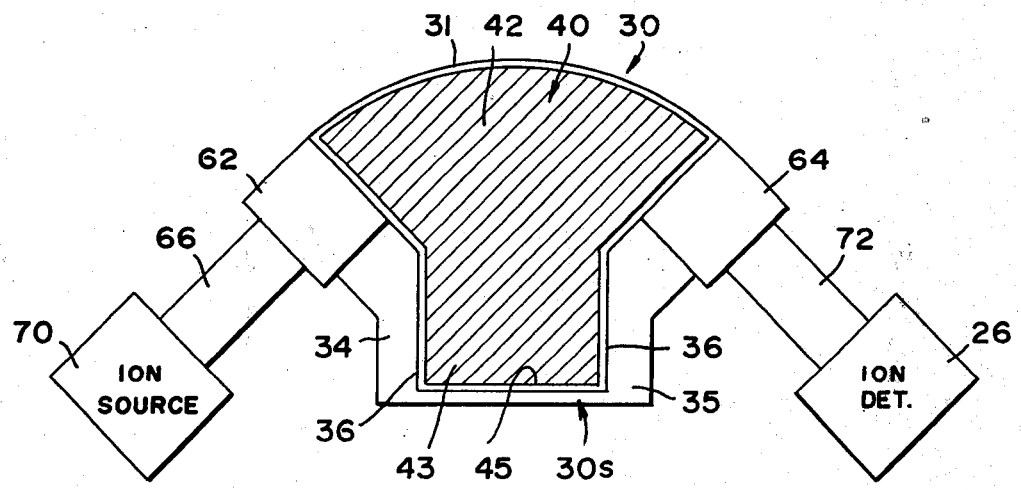
FIG. 4 is a top view of a housing with the novel pole pieces and the connections of the housing to an ion source and an ion detector.

Attention is now directed to FIG. 4 which is a top view of the housing 30 consisting of the structure 30*s* with the pole pieces 40 and 41 welded thereto. As seen therefrom and from FIG. 2, couplings 62 and 64 respectively extend from sides 34 and 35 respectively. In practice, an external duct 66, which extends from an ion source 70 is coupled to the housing 30 by coupling 62, thereby providing a path for the ion beam from the source 70 into the gap 50 in the magnetic sector 10. Similarly, coupling 64 is used to couple another external duct 72 which extends to the ion detector 26. Thus, ions dispersed in the magnetic sector 10 pass to the detector 26 through external duct 72.

It should be stressed however that in the present invention a duct does not pass through the magnetic sector, which is the case in the prior art (see FIG. 1). In the present invention the pole pieces 40 and 41, the back wall 31 and the open side of the vacuum pump 28*a* facing the gap confine the ion beam path, thereby eliminating the need for a duct to pass through the magnetic sector. And, as previously pointed out, due to the absence of the duct in the magnetic sector the gap can be made much smaller thus reducing the size and weight of the magnetic sector.

In operation, the vacuum pump 28*a* evacuates not only the gap 50 but also the external duct 66 (see FIG. 4), through which the ion beam travels from source 70 to the magnetic sector 10, and external duct 72, through which the dispersed ions travel from the magnetic sector 10 to detector 26. However, by placing the vacuum pump adjacent to the magnetic sector 10, certain advantages are realized. Since beam scattering off residual gas molecules can take place in the magnetic sector, it is very important that a near ideal vacuum be present therein. Otherwise, non-evacuated molecules causing ion scattering will degrade MS performance. By placing vacuum pump 28*a* adjacent to the gap 50 highest pumping speed is produced in the gap region, so as to insure the proper vacuum therein and thereby prevent undesired ion scattering. However, it should again be stressed that in addition to evacuating the gap region the pump 28*a* also evacuates the remainder of the MS through external ducts 66 and 72.

In one embodiment actually reduced to practice, the total weight of the magnetic sector and the ion pump was about 1401 grams, or about 3.09 pounds. In it the magnetic field across the gap was on the order of 6333 gauss and the ion-type pump capacity was 1 liter per second. The magnetic field across the pump was on the order of 2000 gauss. By comparison the weight of a conventional magnetic sector with a duct, as shown in FIG. 1, and with a comparable magnetic field across the gap is about 2360 grams of 5.19 pounds. The separate ion pump 28 of the same capacity and the separate magnet 29 which are commercially available from difference sources, e.g., Varian Associates of California weigh on the order of 2724 gram or 6.0 pounds. Thus, in the prior art the total weight of the magnetic sector and the ion pump is about 11.19 pound, while in accordance with the present invention the ductless magnetic sector with the contiguous vacuum pump weigh a total of only 3.09 pounds, producing a weight reduction of $11.19 - 3.09 = 8.1$ pounds. Such weight reduction is most significant for a small portable MS. The above indicated weight reduction does not include the weight of magnetic shielding which may be required if the vacuum pump is not contiguous with the magnetic sector.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A mass spectrometer comprising:

a magnetic yoke;

a pair of spaced apart magnets coupled to said yoke;

a housing including a non-magnetic hollow structure and a pair of spaced apart magnetic pole pieces, forming two opposite sides of said housing, said housing being located with respect to said magnets whereby portions of said pole pieces are in contact with said spaced apart magnets and together therewith and said yoke define a magnetic sector of said mass spectrometer, with the space between the portions of said magnetic pole pieces defining a gap region of said magnetic sector, said housing and portions of said pole pieces extending beyond said magnetic sector and forming and enclosure for ion-type vacuum pump means;

ion-type vacuum pump means located in said housing in the space between the portions of the pole pieces extending beyond said magnetic sector, and in direct communication with said gap region, with said pole pieces providing a magnetic field across the magnetic sector gap region and across said ion-type vacuum pump means;

first means including means coupled to a first end of said housing for providing a path of ions into said gap region; and second means including means coupled to a second end of said housing for providing a path for ions exiting said gap region.

2. The mass spectrometer as described in claim 1 wherein said first means include at least a source of ions and a first duct extending from said source to said first end of said housing, and said second means include an ion detector and a second duct extending from said second end of said housing to said detector, with said first and second ducts providing enclosed paths for ions from said source to said gap region and for ions exiting said gap region to said detector, with said ion-type vacuum means evacuating the entire path of the ions from said source to said detector including said gap region.

3. The mass spectrometer as described in claim 2 wherein said first means further include an electric sector between said source and said magnetic sector whereby, ions from said source pass through said electric sector and therefrom through said gap region through said first duct.

4. The mass spectrometer as described in claim 1 wherein said magnetic sector is a 90° magnetic sector with each of the pole pieces having a portion defining a 90° sector portion and a rectangularly shaped portion extending therefrom with the space between the pole pieces' portions forming part of said 90° magnetic sector being less than the space between the rectangularly shaped pole pieces' portion, with said first and second ends of said housing being in directions forming an angle on the order of 90° therebetween.

5. The mass spectrometer as described in claim 4 wherein said first means include at least a source of ions and a first duct extending from said source to said first end of said housing, and said second means include an ion detector and a second duct extending from said second end of said housing to said detector, with said first and second ducts providing enclosed paths for ions from said source to said gap region and for ions exiting said gap region to said detector, with said ion-type vacuum means evacuating the entire path of the ions from said source to said detector including said gap region.

6. The mass spectrometer as described in claim 5 wherein said first means further include an electric sector between said source and said magnetic sector whereby, ions from said source pass through said electric sector and therefrom through said gap region through said first duct.

7. In a mass spectrometer of the type including at least a source of ions, an ion detector, a magnetic sector, means for providing an enclosed path for ions from said source to said ion detector through a gap region in said magnetic sector and an ion-type vacuum pump requiring a magnetic field for evacuating the path through which ions travel in said mass spectrometer, an arrangement comprising:

a pair of spaced apart magnetic pole pieces having first portions forming part of said magnetic sector with the space between said pole pieces, first portions defining the gap region of said magnetic sector, said pole pieces having second portions extending outwardly from said magnetic sector for providing a magnetic field for said ion-type vacuum pump.

8. The arrangement as described in claim 7 wherein the ion-type vacuum pump is in direct communication with said gap region.

9. The arrangement as described in claim 7 wherein said magnetic sector is a 90° magnetic sector, with the first portions of said pole pieces being in the shape of a 90° sector and their second portions being rectangularly shaped and extending outwardly from said first portions.

10. The arrangement as described in claim 7 wherein said ion-type vacuum pump includes a vacuum tight enclosure which is in direct communication with said gap region said enclosure comprising a plurality of sides of non-magnetic material with said second portions of said pole pieces forming two opposite sides of said enclosure, said vacuum pump including anode and cathode means located between the second portions of said pole pieces forming part of said enclosure.

11. The arrangement as described in claim 10 wherein the distance between the pole pieces' portions defining said gap region being less than the distance between the second portions of said pole pieces between which said anode and cathode means are located.

12. The arrangement as described in claim 11 wherein said magnetic sector is a 90° magnetic sector, with the first portions of said pole pieces being in the shape of a 90° sector and their second portions being rectangularly shaped and extending outwardly from said first portions.

* * * * *